United States Patent [19]

Hayashida et al.

[11] Patent Number: 4,872,470

[45] Date of Patent: Oct. 10, 1989

[54] PORTABLE EMERGENCY SHELTER

[75] Inventors: John P. Hayashida; Roger P. Bowman, both of Waterloo, Canada

[73] Assignee: Her Majesty the Queen in right of Canada, Canada

[21] Appl. No.: 166,899

[22] Filed: Mar. 11, 1988

[51] Int. Cl.[4] ..... E04H 15/36

[52] U.S. Cl. ..... 135/97; 135/101; 135/109

[58] Field of Search ..... 52/2 F, 2 D; 135/97, 135/101, 106, 109

[56] References Cited

U.S. PATENT DOCUMENTS

| | | | |
|---|---|---|---|
| 2,649,101 | 8/1953 | Suits | 52/2 F |
| 3,381,420 | 5/1968 | Brink | 52/2 D |
| 3,407,546 | 10/1968 | Yates | 135/97 |
| 3,965,915 | 6/1976 | Kirkham | 135/97 |
| 4,719,935 | 1/1988 | Gustafson | 52/DIG. 13 |

*Primary Examiner*—Henry E. Raduazo

*Attorney, Agent, or Firm*—Stevens, Davis, Miller & Mosher

[57] ABSTRACT

An emergency shelter for cold climates is disclosed. The shelter has a thermally insulating inner shell shaped to provide an occupant with adequate space for sitting, lying down or performing necessary tasks, while minimizing a technical volume and surface area for thermal efficiency. To this end, the shell has a small foot section, a taller knee section and a taller and wider head section joined to the knee section by an appropriate transition. The shell has an inflatable, impervious, self supporting outer layer and an air pervious, insulating inner layer. A canopy extends over the foot, knee and transition sections to provide a heat transfer diameter around those sections of the shell. The outer layer of the shell has an opening into the heat transfer chamber for ventilation.

14 Claims, 6 Drawing Sheets

PORTABLE EMERGENCY SHELTER

FIELD OF THE INVENTION

The present invention relates to emergency shelters and more particularly to portable emergency shelters suitable for one person occupancy in extremely cold climates.

BACKGROUND

The applicants' U.S. patent application 876,397 filed June 20, 1986, describes a tent with a thermally insulating inner shell and an outer fabric canopy over the shell. The shell and canopy cooperate to provide a heat transfer chamber between them. The present invention relates to certain improvements in a shelter of this type.

SUMMARY

According to one aspect of the present invention there is provided an emergency shelter of the type comprising a thermally insulating shell and a canopy over the shell, wherein the thermally insulating shell is of elongate form, tapered from a head end to a foot end and includes:

a foot section adjacent the foot end, dimensioned to accommodate the feet of a user;

a head section adjacent the head end, with a height greater than that of the foot section and dimensioned to accommodate the head and torso of a user in a upright orientation;

a knee section between the head and foot sections, adjacent the foot section with a height between those of the foot and head sections and dimensioned to accomodate the flexed, upright legs of a user; and a transition section joining the head and knee sections.

This configuration of the thermally insulating shell posture, while minimizing the volume of the shelter that is to be warmed by body heat, and the surface area from which heat is transferred to the cold ambient atmosphere.

According to another aspect of the present invention there is provided an emergency shelter comprising:

A. a thermally insulating shell including a base and walls defining an occupancy chamber, the walls of the shell comprising:

i) a thermally insulating, self supporting, air impervious outer layer with an opening therein; and ii) a thermally insulating, flaccid, air previous inner layer lining the outer layer and extending across the opening therein; and B. a canopy of substantially air impervious material spaced from at least a portion of the walls of the insulating shell to define a heat transfer chamber between the canopy and the shell, the heat transfer and occupancy chambers communicating through said opening.

The use of a fully self-supporting shell layer makes shelter set-up quite simple by eliminating the requirement for a supporting framework. An auxilliary pole structure is an optional addition to make the shelter more resistant to high winds and snow loads. The inner layer of the shell adds insulation and serves to wick moisture away from the occupancy chamber. The use of an extenal heat transfer chamber has been found to provide a significant improvement in the insulating properties of the shelter. Other preferred characteristics of the shelter include a combined slit and tunnel door structure, and an arrangement for inflating the outer layer of the inner shell.

BRIEF DESCRIPTION OF THE DRAWINGS

In the accompanying drawings which illustrate an exemplary embodiment of the present invention.

DETAILED DESCRIPTION

Figure 1:
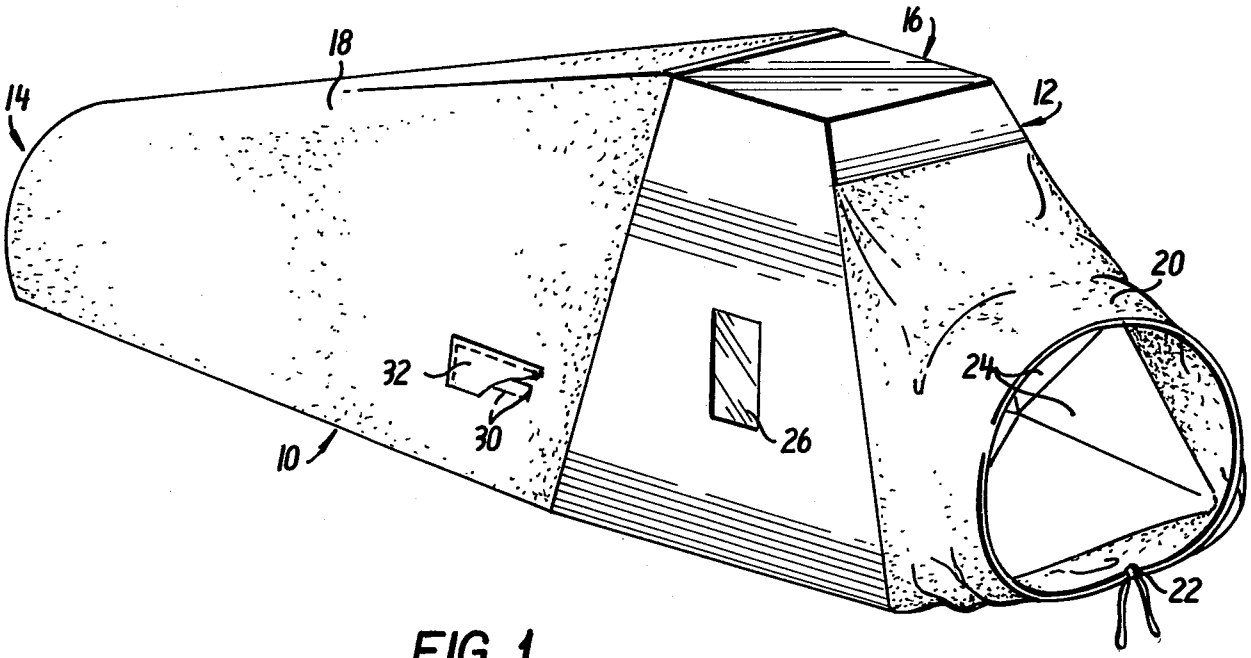
FIG. 1 is an isometric view of a shelter according to the present invention.

Referring to the drawings, and most particularly to FIG. 1, there is illustrated a portable emergency shelter 10 for use in very cold environmental conditions. The shelter, when set up, has an elongated shape tapering in height and width from a head end 12 to a foot end 14. At the head end 12, the shelter has a head section 16 in the shape of a truncated pyramid. The outer shell of the remainder of the tent is a lightweight, substantially impervious fabric canopy 18. The wall of the head section 16 opposite the canopy 18 is fitted with a tunnel door 20, that is a fabric tube that can be closed with a drawstring 22. At the inner end of the tunnel door is a slit door 24 that will be described more fully in the following.

The opposite sides of the section 16 are fitted with windows 26 and 28 as shown in FIGS. 1, 2, 3 and 5.

The canopy 18 is ventilated on each side by two rows of horizontal slits 30. These are protected against the entry of snow by flaps 32 fixed to the outside of the canopy over the slits, with their bottom edges left free.

The detailed structure of the shelter is most particularly illustrated in FIGS. 2 through 8. The main structure is a self-supporting shell 34 illustrated in FIGS. 4, 5 and 6. This shell has a self supporting impervious outer layer consisting of several interconnected, inflatable panels. Each panel is a sheet of open cell foam is a gas tight envelope of urethane coated nylon fabric. Each panel has an air inlet/outlet opening so that the panel can be deflated for packing or inflated to set up the shelter.

The outer layer of the shell 34 includes a flat end panel 36 at the foot end of the shelter. This has the shape of a half elipse as shown most particularly in broken line in FIG. 6. The end panel 36 is joined to an arched panel 38 to define a foot section 39 of the shell. The panel 38 abuts a panel 40 that is likewise arched in configuration, but increases in height from the foot section towards the head end of the shelter. This defines a knee section 41 of the shelter that is of sufficient height to accommodate the flexed knees of a supine occupant. At the end of the knee section wall panel 40 is a transition panel 42 defining a transition section 43 that increases in width from the knee section of the head section 16, while the height remains constant. The transition section wall panel 42 is bevelled off short of the head section to provide an opening between the transition section and the head section. The head section itself consists of two trapezoidal walls 44 and 46, a top wall 48, two short trapezoidal sections 50 and 52 and a door panel 54 containing the slit door 24. The walls 44 and 46 contain the windows 26 and 28 respectively, while the wall section 50 lines up with the door panel 54 to completely close the head end of the shelter.

The outer layer of shell 34 is completed with a base or floor panel 55. The tunnel door 20 is affixed to the periphery of the door panel 54. The canopy 18 covers the foot, knee and transition sections and has its end secured around the heazd section 16 at the end away from the door. With the shelter set up, the canopy is stretched between the foot and head sections and spaced from the shell to provide a heat transfer chamber 60.

The gap between the bottom edge of the wall section 52 and the bevelled forward edge of the transition section wall 42 defines an opening 56 communicating the occupany chamber 58 of the shelter with the heat transfer chamber 60 between by the canopy 18 on the outside and the shell 34 on the inside.

Figure 7:
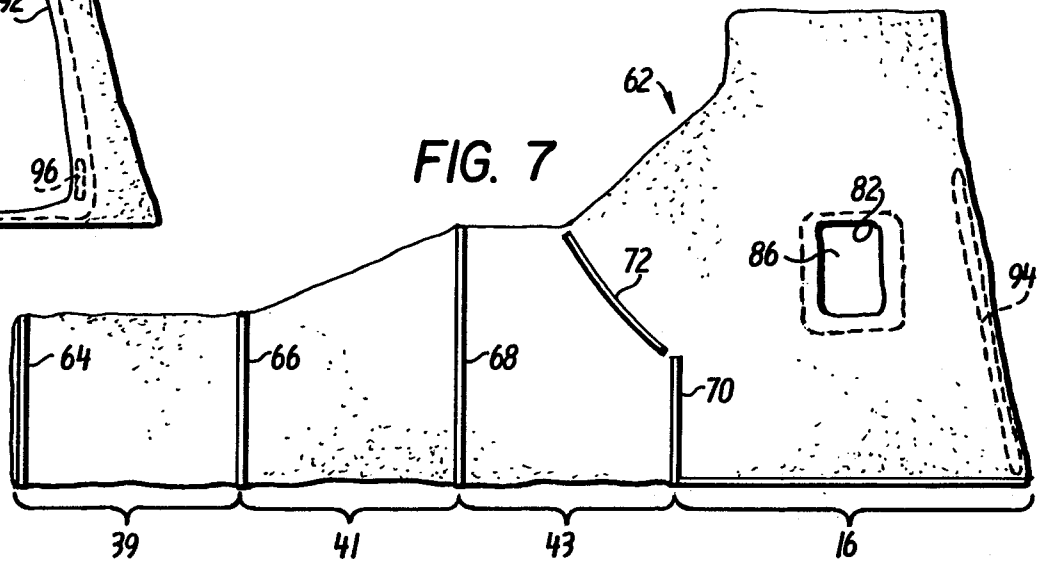
FIGS. 7 and 8 are side and head end elevations of the inner layer of the inner shell.
Figure 8:
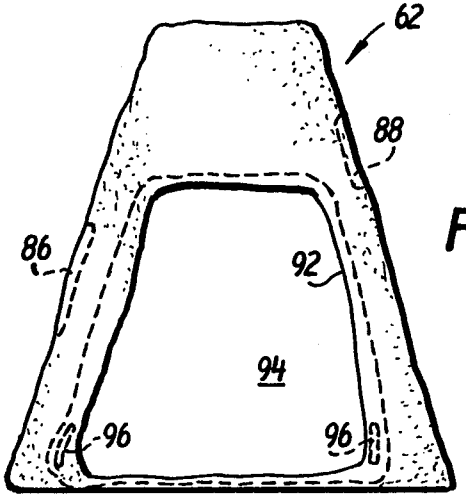

The outer layer of the shell 34 has an air pervious inner layer or liner 62 made of two layers of thermally insulating synthetic fiber batting separated by an interlayer of perforated reflective foil and enclosed in an air pervious fabric cover. This liner provides additional insulation to the shell and extends across the opening 56 to provide an air pervious, insulating section of the shell. The liner is supported in position by strips of hook and loop pile fasteners of the type sold under the trademark "Velcro". These are located as illustrated in FIG. 7 where a fastener strip 64 is shown extending over the foot section wall 38 adjacent the end panel 36 and similar strips 66 and 68 are located at the junctures between the foot, knee and transition sections of the shell. Additional strips 70 and 72 are located along the ede of the transition section 42, where it joins the head section 16 and borders the opening 56. The head section of the liner is supported in place by a frame 74 that also serves to support the head section 16 of the shelter against deformation due to high winds and snow loads. The frame consists of four connector blocks 76 located at the four corners of the top panel 48 of the head section 16. These have sockets to receive the ends of four rods 78 to define a rectangular support extending around the perimeter of the top of the head section 36. The connector blocks 76 also have sockets to receive respective ones of four upright supports 80 extending from the blocks to seat in sockets formed in the floor panel 55. The supports 80 are tubular, shock corded elements of the type that are conventionally used as tent poles. The complete frame can thus readily be collapsed into a small volume immediately below the top of the head section 34.

Figure 2:
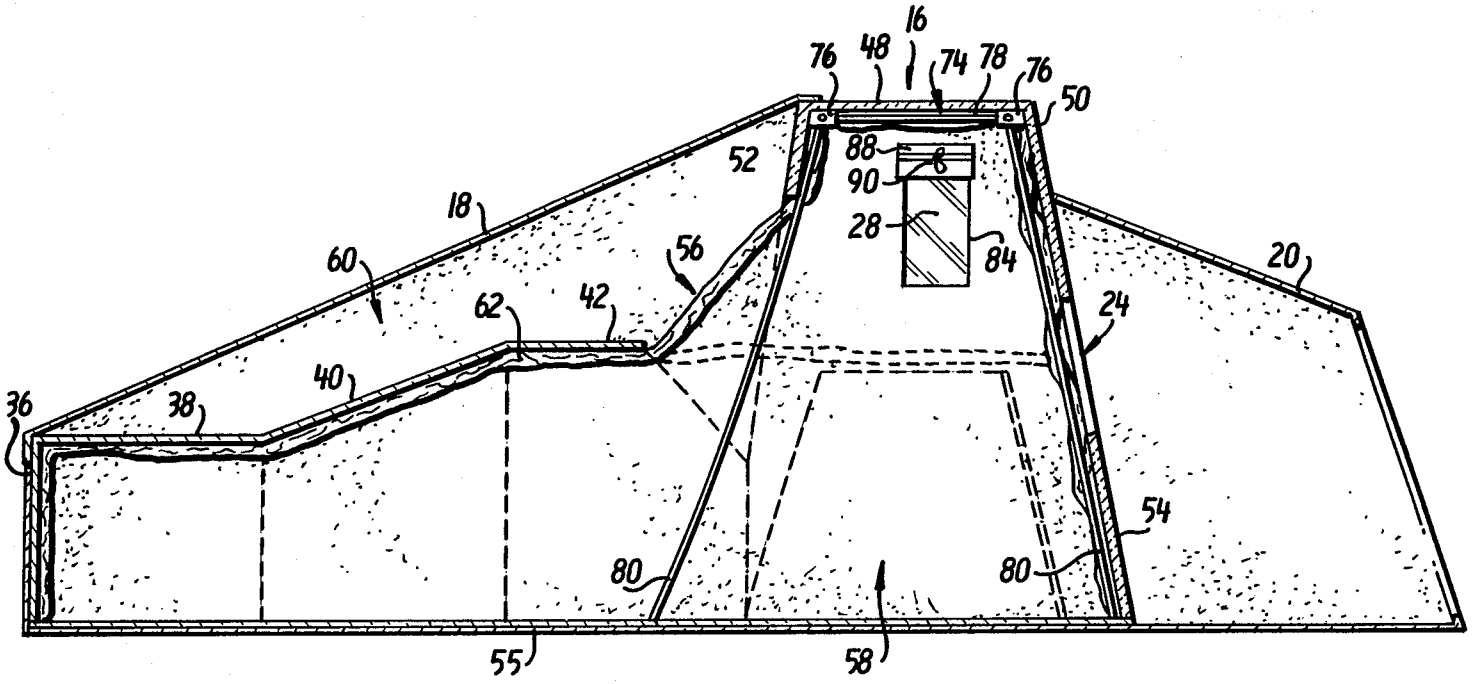
FIG. 2 is a longitudinal cross section of the shelter of FIG. 1.
Figure 3:
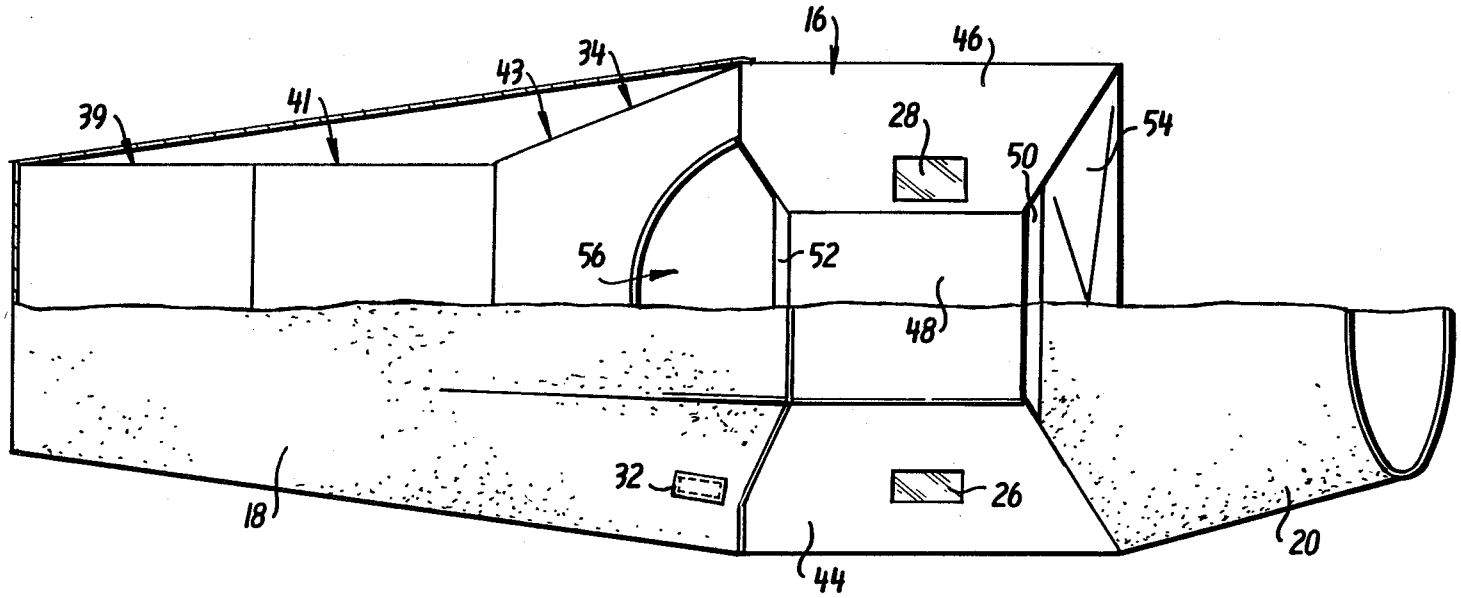
FIG. 3 is a plan view of the shelter of FIG. 1, with one half showing the outer shell removed.
Figure 5:
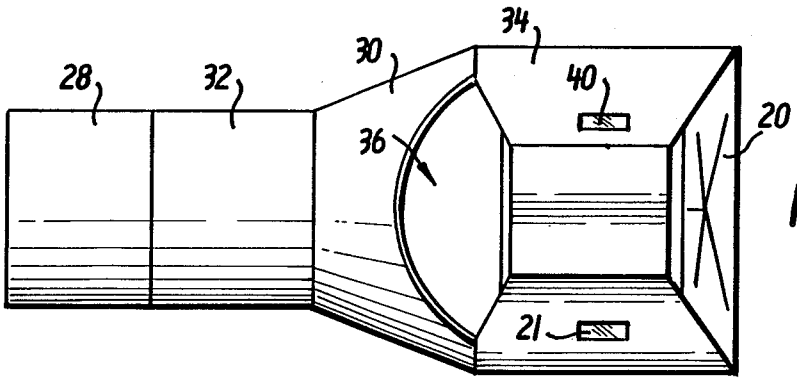
FIGS. 4, 5 and 6 are side elevation, plan and head end elevation views of the outer layer of the inner shell of the shelter of FIG. 1.
Figure 6:
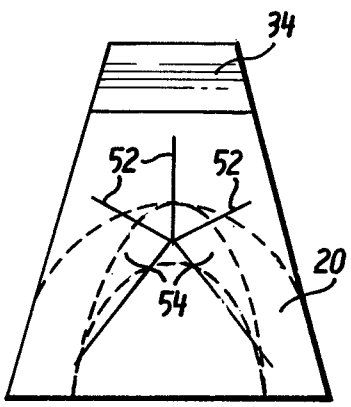
Figure 4:
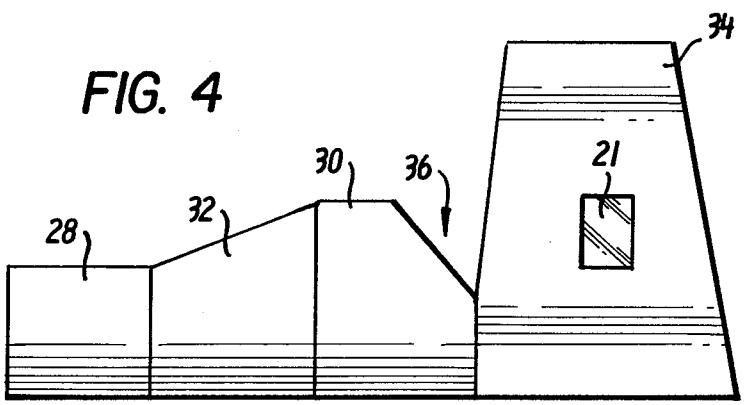

FIG. 2 illustrates in broken line as optional characteristic of the shelter that may be employed to reduce the interior volume of the shelter, for example during sleeping periods. This involves disconnecting the lower sections of the supports 80 and lowering the frame 74 to lower the head section of the liner 62. This reduces the volume of the shelter that must be warmed by an occupants body heat in order to maintain an adequate temperature within the shelter.

The liner 62 has window openings 82 and 84 that are located over the window 26 and 28 respectively of the outer layer of the shell. To ensure adequate insulation, flaps 86 and 88 are arranged to extend over these openings and to be rolled up as necessary to admit light. Appropriate fasteners, such as string ties 90 may be used to hold the flaps in the open position.

The door panel 24 confronts a door opening 92 in the liner 62. This is, like the windows, covered with a flap 94 of the liner material. The door flap 94 is held in its closed position by strips 96 of hook and loop pile fastener material.

The slit door of the shell 34 consists of five slits 98 formed in the door panel 54 at the head end of the tent. These radiate from a common point centered on the tunnel door 20. The resultant triangular flaps 100 are resilient and can readily be deformed to allow ingress or egress by an occupant of the shelter.

Figure 9:
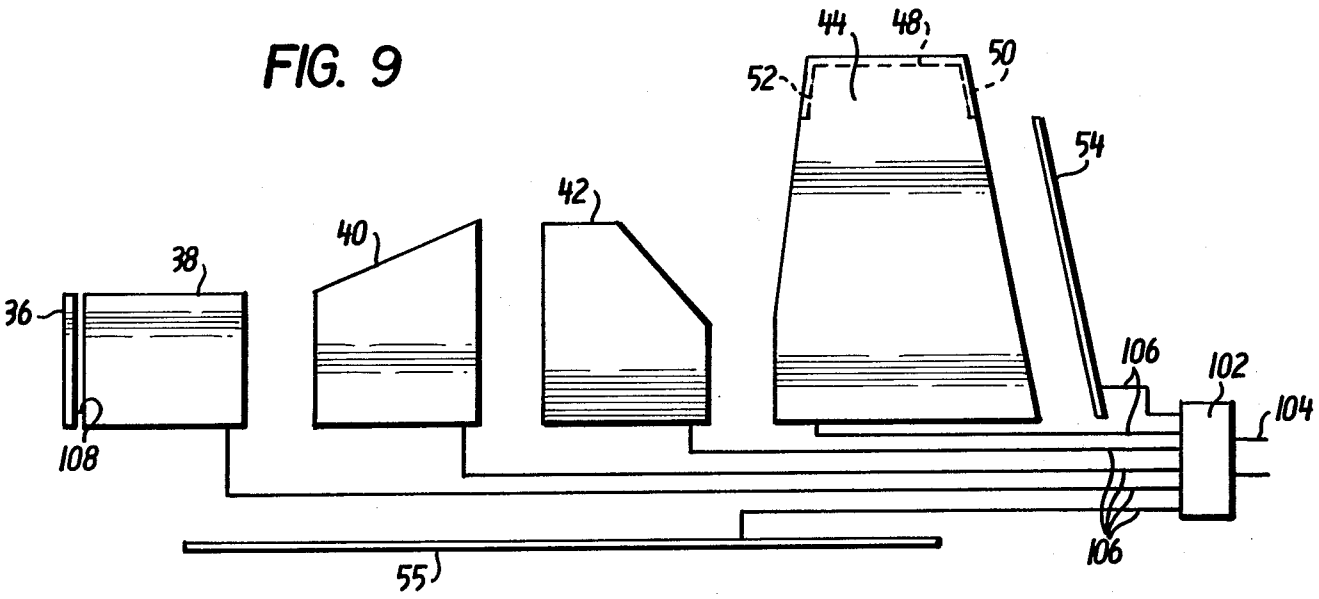
FIG. 9 is a schematic view showing a system for inflating the various panels of the outer layer of the inner shell.

Turning to FIG. 9, this drawing shows schematically an arrangement for inflating the various wall panels of the shell 34. To inflate the panels, the shelter is equipped with a manifold of 102 having an inlet 104 and plural outlet tubes 106 leading to individual ones of the panels. In the foot section, there is a tube 108 joining the wall panels 38 to the end panel 36. Each tube 106 is a cloth tube that is flat when uninflated, so as to minimize both weight and space. The manifold is valved to prevent the egress of inflating gas from the inflated panels. The gas may be injected from a gas cartridge, a manual pump, or by mouth. In view of the shelter's intended use as an emergency shelter, at least two of these mechanisms are preferably provided with any unit. It is particularly advantageous to inflate the shell with a low conductivity gas, for example a mixture of carbon dioxide and nitrogen.

The illustrated embodiment of the shelter, when packaged for transport, is collapsed by evacuation of the impervious layer of the inner shell. The supports 80 of the frame 74 are collapsed and laid flat within the top of the head section 48. The whole unit is vacuum packaged to keep it as small as possible. For erection, the package is opened and the impervious layer of the shell 34 is inflated by injecting gas through the inlet 104 to manifold 102. This inflates the shell and completely erects the shelter. The shelter can then be entered by an occupant. The supports 80 of the head section frame 74 are at this time dangling loose. They can readily be assembled and seated in appropriate sockets in the floor panel 55. As illustrated in the drawings, the windows 26 and 28 on opposite sides of the head section 16 are different heights. This provides alternative sources of light or fields of view, an arrangement which an occupant either lying down or sitting up.

The body heat of an occupant serves to warm the interior of the shelter. The heat transfer chamber 60 formed between the canopy 18 and the shell 34 communicates with the occupancy chamber 58 of the shelter through the opening 56 in the shell 34. The heat transfer chamber provides substantially increased insulation to the shelter, while the air pervious section of the shell allows for an adequate exchange of fresh air between the heat transfer chamber and the occupancy chamber. Fresh air is admitted to the heat transfer chamber through the ventilating slits 30 in the sides of the canopy 18.

The shape of the shell 34 has been designed to accommodate an occupant in a recumbant position with knees flexed (hence the increased height of the knee section) and in a sitting position at the head end 16. This allows for virtually any activity that is necessary within an emergency shelter of this type.

While one embodiment of the invention has been described in the foregoing, it is to be understood that the invention is not limited to that precise construction. The invention is intended to be limited solely by the language of the appended claims.

We claim:

1. An emergency shelter of the type comprising a thermally insulating shell and a canopy over the shell, wherein the thermally insulating shell is of elongate form, tapered from a head end to a foot end and includes:

a foot section adjacent the foot end, dimensioned to accommodate the feet of a user;

a head section adjacent the head end, with a height greater than that of the foot section and dimensioned to accommodate the head and torso of a user in an upright orientation;

a knee section between the head and foot sections adjacent the foot section, with a height between those of the foot and head sections and dimensioned to accommodate the flexed, upright legs of a user;

a transition section joining the head and knee sections and a canopy of flaccid material enclosing and spaced from the foot, knee and transition sections of the thermally insulating shell to define a heat transfer chamber between those sections and the canopy.

2. A shell according to claim 1, wherein the insulating shell comprises an air impervious layer with an opening into the heat transfer chamber adjacent the head section and an air pervious layer covering the opening.

3. An emergency shelter comprising:

A. a thermally insulating shell including a base and walls defining an occupancy chamber, the walls of the shell comprising:

i) a thermally insulating, self-supporting, air impervious outer layer with an opening therein; and ii) a thermally insulating, flaccid, air pervious inner layer lining the outer layer and extending across the opening therein; and B. a canopy of substantially air impervious material spaced from at least a portion of the walls of the insulating shell to define a heat transfer chamber between the canopy and the shell, the heat transfer and occupancy chambers communicating through said opening.

4. A shelter according to claim 3, wherein the outer layer is inflatable and is self supporting when inflated.

5. A shelter according to claim 4, wherein the outer layer is an open cell foam covered with an air impervious membrane.

6. A shelter according to claim 3, including means for inflating the outer layer.

7. A shelter according to claim 6, wherein the means for inflating the outer layer include a supply of mixed carbon dioxide and nitrogen gases.

8. A shelter according to claim 4, wherein the outer layer is constructed in plural independently inflatable sections.

9. A shelter according to claim 8, including a manifold and valving apparatus for inflating the plural sections of the outer layer independently from a common source.

10. A shelter according to claim 3, wherein the inner layer is secured to and supported by the outer layer.

11. A shelter according to claim 10, wherein the inner layer is a fibrous batting material with a perforated radiative foil interlayer.

12. A shelter according to claim 3, including a tunnel door secured to the shell.

13. A shelter according to claim 12, including a slit door in a door panel of the outer layer of the shell confronting the tunnel door, the slit door comprising a plurality of slits in the door panel defining plural flaps radiating from a central location.

14. A shelter according to claim 13, wherein the inner layer includes a panel releasably securable to the inside of the door panel to cover the slit door.

* * * * *